US007696644B2

(12) United States Patent
Metz et al.

(10) Patent No.: US 7,696,644 B2
(45) Date of Patent: Apr. 13, 2010

(54) WIRELESS POWER TRANSFER SYSTEM FOR GLASS

(75) Inventors: Reinhard Metz, Wheaton, IL (US); Warren Graber, Hoffman Estates, IL (US)

(73) Assignee: CookTek LLC, Chicago, IL (US)

( * ) Notice: Subject to any disclaimer, the term of this patent is extended or adjusted under 35 U.S.C. 154(b) by 571 days.

(21) Appl. No.: 11/671,541

(22) Filed: Feb. 6, 2007

(65) Prior Publication Data

US 2008/0185918 A1 Aug. 7, 2008

(51) Int. Cl.
*H01F 38/14* (2006.01)
*B60L 1/02* (2006.01)

(52) U.S. Cl. ..... 307/104; 219/203

(58) Field of Classification Search ..... 307/104; 219/520–522, 740, 203
See application file for complete search history.

(56) References Cited

U.S. PATENT DOCUMENTS

| | | | | |
|---|---|---|---|---|
| 2,065,760 | A | 12/1936 | Smith | |
| 2,527,720 | A | 10/1950 | Guyer | |
| 3,263,063 | A | 7/1966 | Marriott et al. | |
| 4,031,356 | A | 6/1977 | Niibe | |
| 4,248,015 | A | 2/1981 | Stromquist et al. | |
| 4,278,875 | A * | 7/1981 | Bain | 219/522 |
| 4,929,005 | A | 5/1990 | Heinen | |
| 5,170,040 | A | 12/1992 | Wirtz et al. | |
| 5,594,316 | A | 1/1997 | Hayashida | |
| 5,714,199 | A | 2/1998 | Gerhardinger et al. | |
| 5,852,284 | A * | 12/1998 | Teder et al. | 219/522 |
| 6,024,084 | A | 2/2000 | Gerhardinger | |
| 6,144,017 | A | 11/2000 | Millett et al. | |
| 6,184,837 | B1 | 2/2001 | Lindenmeier et al. | |
| 6,535,133 | B2 | 3/2003 | Gohara | |
| 6,736,646 | B2 | 5/2004 | Takahashi et al. | |
| 7,041,942 | B2 | 5/2006 | Gerhardinger | |
| 7,053,343 | B2 | 5/2006 | Gerhardinger et al. | |
| 7,259,359 | B2 * | 8/2007 | Davey et al. | 219/522 |
| 7,340,907 | B2 * | 3/2008 | Vogh, III | 62/150 |

FOREIGN PATENT DOCUMENTS

| | | |
|---|---|---|
| DE | 19818132 A1 | 12/1999 |
| JP | 11054711 | 9/2000 |
| JP | 11229372 | 2/2001 |
| JP | 2002279406 | 4/2004 |
| WO | WO9626449 | 8/1996 |

* cited by examiner

*Primary Examiner*—Albert W Paladini
(74) *Attorney, Agent, or Firm*—Michael P. Mazza

(57) ABSTRACT

A power transfer system for imparting power to at least one functional element, such as a movable glass-containing functional element, such as a sliding glass door. The power transfer system preferably includes a magnetic induction power transfer mechanism with a power transfer circuit having first and second separated coils, and a resonant circuit power driver having a resonant frequency. The power transfer mechanism is designed to apply power to the functional element and/or to other devices or systems connected to it. The power transfer system may include an electronic feedback mechanism with an electronic feedback circuit for sensing a predetermined condition concerning the functional element. To take one example, the electronic feedback circuit may be used to provide safety door detection feedback by sensing the position of a movable glass portion of sliding glass doors, and by relaying a feedback signal, which may be carried by a light wave, to the power transfer mechanism if the movable glass portion of the doors is determined to be in a closed position. A data link may be used to communicate information between the power transfer circuit and the functional element.

22 Claims, 3 Drawing Sheets

WIRELESS POWER TRANSFER SYSTEM FOR GLASS

BACKGROUND OF THE INVENTION

The present invention generally relates to wireless power transfer systems for movable glass. More particularly, the invention relates to wireless power transfer systems using magnetic induction applied to movable glass, such as but not limited to glass doors and windows.

Heated glass systems have been developed, as shown for example in U.S. Pat. No. 7,053,343 to Gerhardinger, incorporated herein by reference in its entirety. With such systems, glass may be equipped with an electrically conductive and optically transparent film located on an inner surface of the glass. Electrical current passing through the film heats the glass. However, when the glass is movable, such as glass used in doors or windows, for example, there is a need for supplying power to the movable glass without using direct wired connections. Direct wired connections or connections made by electrical contact may not be permissible given local electrical codes, and may not be feasible, safe, or desirable given the application. Flexing direct connections generally lack in durability and contact connections pose a shock hazard. Some disadvantages of current electrical controls, including but not limited to direct wired connections, include: bulkiness and lack of mounting space; electric shock potential; and electrical interference generated by the electrical controls.

Accordingly, there is a need to supply power to movable glass in order to heat the glass, or to provide power for other reasons, such as lighting, sound, or other effects, while overcoming at least some of the disadvantages of current electrical controls.

DEFINITION OF CLAIM TERMS

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

"Resonant circuit power driver" means a power driver circuit that includes an inductance and capacitance load circuit that has a natural resonant frequency.

SUMMARY OF THE INVENTION

The objects mentioned above, as well as other objects, are solved by the present invention, which overcomes disadvantages of glass systems employing current electrical controls, while providing new advantages not previously obtainable with such systems.

In a preferred embodiment, a power transfer system is provided for imparting power to functional elements. The power transfer system includes a magnetic induction power transfer mechanism with a power transfer circuit. The power transfer circuit includes at least first and second separated coils and a resonant circuit power driver having a resonant frequency. The power transfer mechanism is designed to apply power to elements associated with the movable glass.

In a particularly preferred embodiment, the first and second coils may be primary and secondary coils, and may be wound on a ferrite core. The resonant circuit power driver may be connected to the primary coil. In the particularly preferred embodiment, the resonant circuit power driver produces sine waves, although in a less preferred embodiment it may produce pulse width modulated or square waves.

The principles of the invention are broad enough to work with various functional elements, including sliding glass doors, bifold doors, swinging doors, windows, stationary doors and windows, lighted signs, etc. In one preferred embodiment, the functional element includes at least one movable glass portion having an electrically conductive and optically transparent film; when electrical current supplied by the power transfer mechanism passes through the film, the film may be caused to heat the glass. The power transfer system may include an electronic feedback mechanism with an electronic feedback circuit for sensing a predetermined condition concerning the functional element. For example, the electronic feedback circuit may sense the position of the movable glass portion of the doors, and relay a feedback signal to the power transfer mechanism if the movable glass portion of the doors is determined to be in a closed position. The feedback signal may be a light beam, for example, and may result in the application of power to the sliding glass doors, as another example. As a further example, the electronic feedback mechanism, upon sensing the movable glass portion of the doors to be in a closed position, may signal to the power transfer mechanism a sliding glass door characteristic, which may include one or more of the following: temperature; power delivered to the door; or fault conditions.

In an alternative embodiment, a data link may be used to communicate information to the power transfer circuit derived from the electronic feedback circuit. The electronic feedback circuit may be powered by the power transfer circuit. Power from the power transfer circuit may be used for lighting or sound applications in conjunction with the functional element, or in conjunction with other elements or systems.

In a preferred embodiment, the resonant circuit power driver may include a self-resonant driver producing sine waves which are synchronous with the resonant frequency regardless of load. Preferably, the frequency of the resonant circuit power driver remains synchronous with the resonant frequency as load on the power driver changes.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

Figure 1:
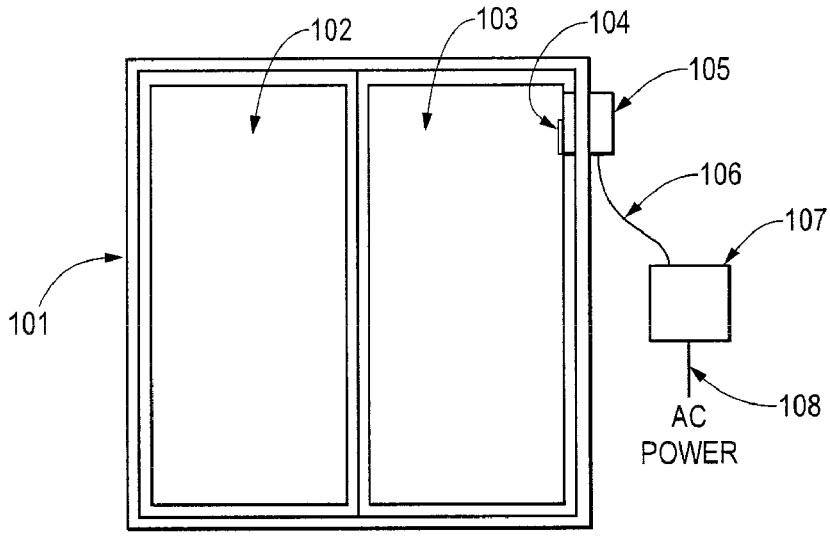
FIG. 1 is a schematic diagram of a sliding glass door equipped with an induction power transfer system according to a preferred embodiment of the present invention.

The components in the drawings are not necessarily to scale, emphasis instead being placed upon clearly illustrating the principles of the present invention.

DETAILED DESCRIPTION OF THE PREFERRED EMBODIMENT

In a preferred embodiment of the present invention, the method of power transfer employs a magnetic induction system. In a particularly preferred embodiment, the magnetic induction system utilizes separate coil assemblies, and more particularly a split core transformer, as well as a power driver such as, preferably, a resonant sine wave power driver. Feedback mechanisms may be used for proper load presence detection and other information transfer, as described below, which may be data linked for informational purposes and/or to drive power to other devices, such as also described below.

Referring to FIG. 1, a sliding glass door equipped with a magnetic induction power transfer system according to the present invention is provided to illustrate principles of the present invention using one specific, non-limiting application. (Of course, in addition to powering or heating other devices, as explained below, the embodiment discussed here could be used to power or heat swinging doors, bifold doors, windows, or other stationary or movable glass items, for example.) Door frame 101 surrounds stationary and movable thermopane glass panels 102, 103, respectively, each equipped with a transparent resistive heating film (not shown). Power receiving and power transmitting coil assemblies 104, 105, respectively, may be provided on opposite sides of a portion of the door frame adjacent the movable glass panel 103. A wired (e.g., wire 106) connection may be provided between power transmitting coil assembly 105 and power inverter circuit 107, which may be powered by an appropriate connection 108 to an AC power source.

Figure 2:
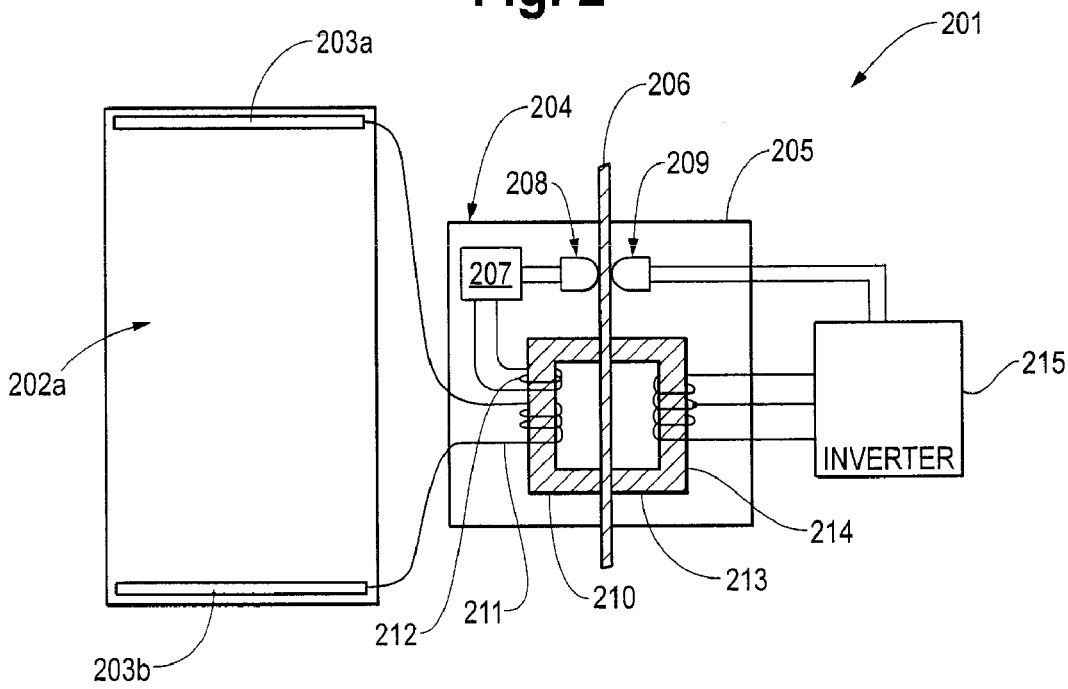
FIG. 2 is a schematic diagram of an induction power transfer system and door detection feedback circuit according to a preferred embodiment of the invention.

Referring to FIG. 2, an exemplary power transfer system and door detection feedback circuit, generally designated as system 201, may be provided. Appropriate power inverter and control electronics 215 may be provided, as further explained below in connection with the discussion of the schematic shown in FIG. 3. Power inverter and control electronics 215 may be connected to power transmit coil winding 214 of power transmitting coil assembly 205. Power receiving coil 211 in power receiving coil assembly 204 may then be connected to a thermopane glass panel 202*a* having a transparent resistive heating film (not shown). Electrical connections 203*a*, 203*b* may be provided to the transparent heating film. The power receiving and power transmitting coils 211 and 214 may further be wound on a pair of Ferrite cores 210 and 213, respectively, which may be configured and located as shown. A gap spacer 206 may be used. Gap spacer 206 may serve as a mechanical buffer, as ferrite is a brittle material which may be damaged should the ferrite pieces contact each other. Additionally, gap spacer 206 may also be used to accurately control the amount of power delivered to the load (as the coil is located closer to the door, the inductance increases). Power delivered may also be controlled by varying the number of turns on secondary winding 211. For an exemplary transparent resistive heating film having a resistance of 20 ohms and 500 watts of delivered power, the power receiving winding 211 may have 20 turns and the power transmit winding 214 may have 26 turns center tapped. A power and drive circuit 207 may be provided to accept a portion of the received power and to provide a feedback signal to be used as a door detection safety mechanism. The presence of the door and its power receiving coil assembly 204 generates a signal which may further be provided to an infrared light emitting diode 208 and an infrared light sensor 209. Infrared light sensor 209 may then in turn provide a signal to the power inverter and control electronics 215, indicating the presence of the door. In the preferred embodiment, the inverter circuit 215 may periodically operate in a pinging mode, until the feedback signal is detected, subsequently applying full power only when the feedback signal is detected and removing power when it is lost, ensuring that the door is present and closed, and power will not be delivered to any load other than the door. While the infrared signaling mechanism is the preferred embodiment, this mechanism could clearly be provided by other means, as well, such as by using a radio frequency signal.

Figure 3:
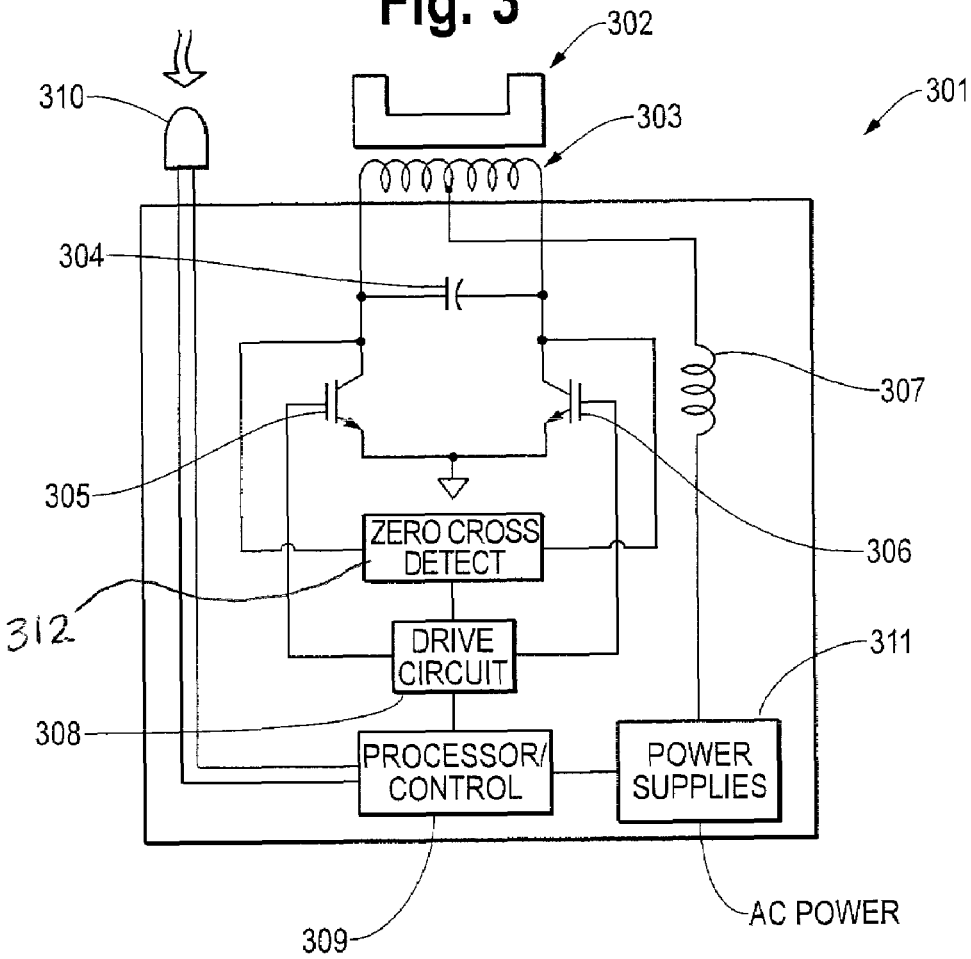
FIG. 3 is a schematic diagram of a power inverter and control electronics according to a preferred embodiment of the invention.

Referring to FIG. 3, exemplary power inverter and control electronics are shown configured in an assembly generally designated by reference numeral 301. In a preferred embodiment, assembly 301 may include: ferrite core 302; power input coil and resonant inductor 303; resonant capacitor 304; power transistors 305, 306; current mode series inductor 307; drive/control circuit 308; control processor 309; infrared light sensor 310; power supply 311, and zero crossing detection circuit 312. Zero crossing detection circuit 312 provides trigger signals to drive circuit 308, allowing the power transistors 305 and 306 to be turned on and off in perfect synchronism with the natural resonant frequency of the capacitor 304 and inductance of the power transfer coils and impedance of the effective load, regardless of the actual load. This significantly improves overall efficiency of the system. Assembly 301 may be used to generate a sine wave power signal into primary coil 303. Assembly 301 may also be used to provide the power supply connection to an AC power line. Processor 309 may be used to power the assembly on and off, control the level of power delivered, and to interface with the (e.g.) infrared light beam returning from the feedback circuit described in connection with FIG. 2.

Figure 4:
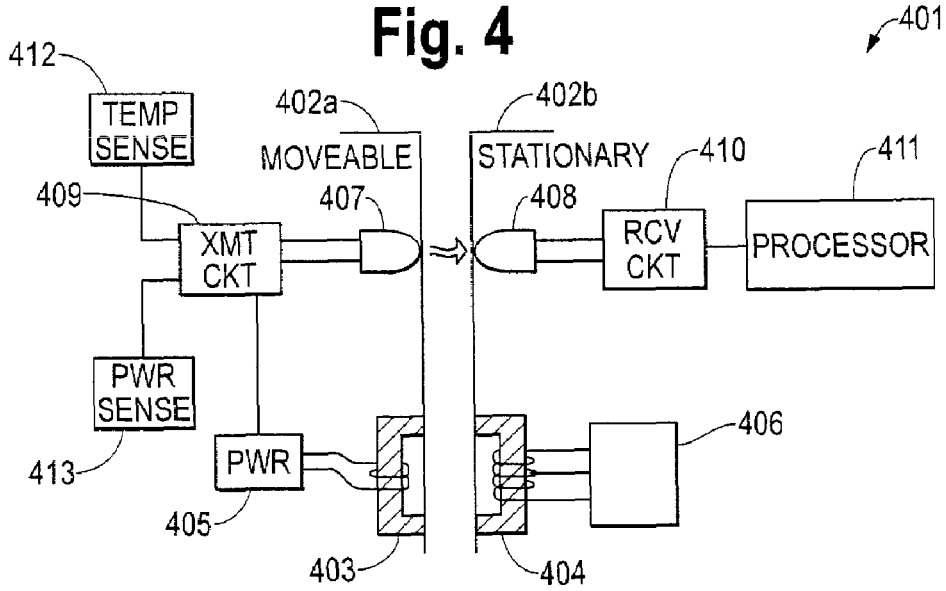
FIG. 4 is a schematic diagram of an induction power transfer system and remote data communication subsystem according to a preferred embodiment of the invention.

Referring to FIG. 4, a power transfer system with remote data communication sub-system is shown, and generally designated as system 401. System 401 includes movable (402*a*) and stationary (402*b*) assemblies; power receiving (403) and power transmitting (404) coils; power circuit 405; inverter circuit 406; infrared LED 407; infrared light sensor 408; transmitting circuit 409; receiving circuit 410; processor/controller 411; temperature sensing circuit 412; and power sensing circuit 413. System 401 receives the infrared light signal from the door detection feedback circuit shown in FIG. 2, and may provide one or more data links, such as temperature sensing circuit 412 and power sensing circuit 413, which are exemplary of such a function, to transmit back remote data about the door's location or temperature or power characteristics, for example, through the data link.

Figure 5:
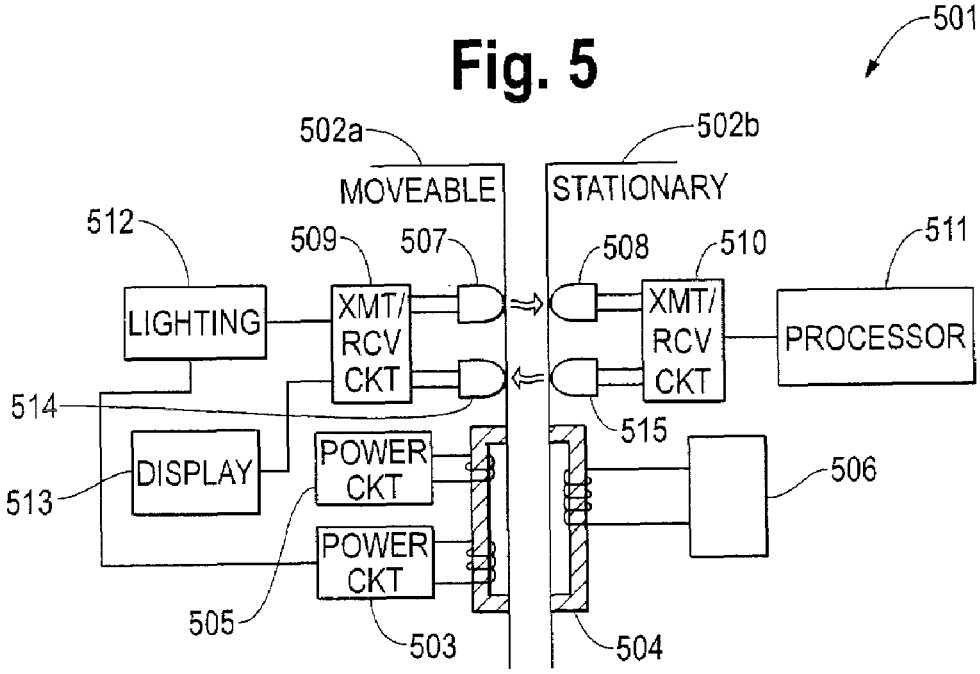
FIG. 5 is a schematic diagram of an induction power transfer system with remote data communication and a control subsystem according to a preferred embodiment of the invention.

Referring to FIG. 5, a power transfer system with remote data communication capabilities using a control subsystem is shown, and generally designated as 501. System 501 includes: movable (502*a*) and stationary (502*b*) assemblies; power receiving (503) and power transmitting (504) coils; power circuit 505; inverter circuit 506; infrared LED 507; infrared light sensor (508); transmitting/receiving circuit 509; receiving/transmitting circuit 510; processor/controller 511; remote lighting circuit/assembly 512; remote graphical or alphanumeric display 513; infrared light sensor 514; and infrared LED 515. System 501 is similar in concept to system 401 shown in FIG. 4, but is now a bidirectional system. In other words, in addition to the information transmitted by the infrared light beam from (e.g., in the swinging door example) the door about the door's position (e.g., as closed or open), or its temperature characteristics or power delivered for heating it, for example, information may be transmitted to the door. This information may then, for example, be used to control devices or components in or on the door, such as lights 512 or displays 513.

Figure 6:
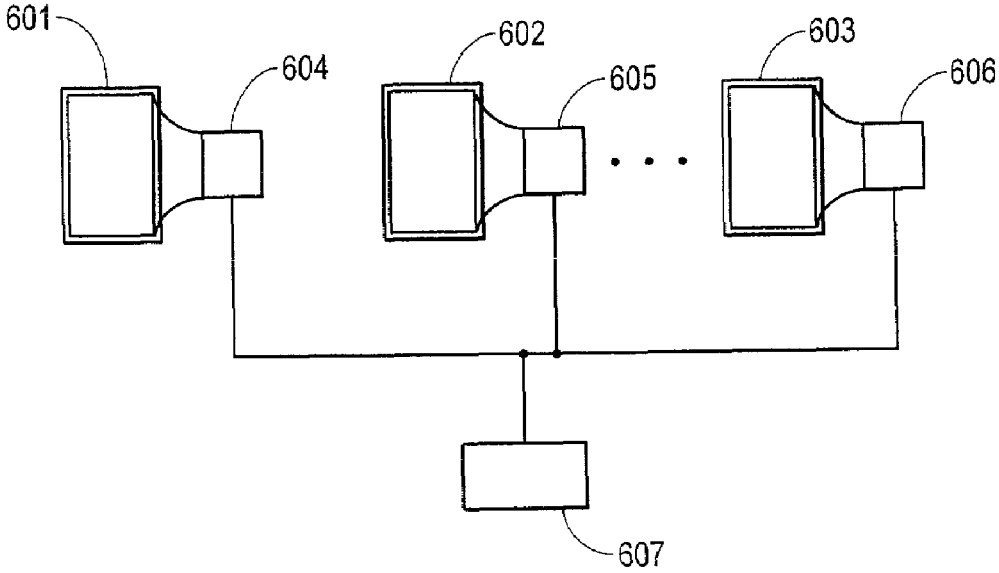
FIG. 6 is a schematic diagram showing a number of heated glass doors and their associated power inverters and control electronics, remotely controlled by a remote control unit to enable centralized management.

It will be understood that any of the functions described here may be controlled remotely, using appropriate remote-controlled devices. FIG. 6 shows a number of heated glass doors 601, 602, and 603 and their associated power inverters and control electronics 604, 605, and 606 remotely controlled by remote control unit 607 to enable centralized management. The remote control interface may be implemented in either a wired or wireless fashion.

The above description is not intended to limit the meaning of the words used in the following claims that define the invention. For example, while preferred embodiments involving power induction principles applied to movable glass have been described above, persons of ordinary skill in the art will understand that a variety of other designs still falling within the scope of the following claims may be envisioned and used. It is contemplated that future modifications in structure, function or result will exist that are not substantial changes and that all such insubstantial changes in what is claimed are intended to be covered by the claims.

We claim:

1. A power transfer system for imparting power to at least one functional element associated with at least one glass portion, comprising:

a magnetic induction power transfer mechanism including a resonant circuit power driver having a resonant frequency, and a power transfer circuit comprising at least first and second separated coils;

the resonant circuit power driver being electrically connected to the first coil, power being transferred from the first coil to the second coil by magnetic induction, and the second coil being electrically connected to the at least one functional element associated with the at least one glass portion;

wherein the at least one functional element associated with the at least one glass portion comprises an electrical element or circuit to which power is to be supplied.

2. The power transfer system of claim 1, wherein each of the first and second coils is wound on a metallic core.

3. The power transfer system of claim 2, wherein each of the first and second coils is wound on a ferrite core.

4. The power transfer system of claim 1, wherein the resonant circuit power driver produces sine waves.

5. The power transfer system of claim 1, wherein the resonant circuit power driver produces pulse width modulated or square waves.

6. The power transfer system of claim 1, wherein the at least one functional element comprises an electrically conductive film for heating the glass.

7. The power transfer system of claim 6, wherein the at least one glass portion comprises sliding glass doors having a movable glass element and a stationary glass element.

8. The power transfer system of claim 6, wherein the power transfer system is used to impart power to at least one of the following: bifold doors; swinging doors; a lighted sign; digital, addressable display devices; and movable windows.

9. The power transfer system of claim 6, further comprising an electronic feedback mechanism including an electronic feedback circuit for sensing a predetermined condition concerning the at least one glass portion.

10. The power transfer system of claim 9, wherein the electronic feedback circuit senses the position of the at least one glass portion, and relays a feedback signal to the power transfer mechanism if the at least one glass portion is determined to be in a predetermined dosed position.

11. The power transfer system of claim 10, wherein the signal relayed to the power transfer mechanism results in the application of power to a sliding or swinging glass door.

12. The power transfer system of claim 10 where the feedback signal comprises a light beam.

13. The power transfer system of claim 10, wherein the electronic feedback mechanism, upon sensing the predetermined position of the at least one glass portion, signals to the power transfer mechanism a glass door characteristic.

14. The power transfer system of claim 13, wherein a glass door characteristic includes one or more of the following: temperature; power delivered to the door; or fault conditions.

15. The power transfer system of claim 9, further comprising a data link for providing bidirectional communication of information.

16. The power transfer system of claim 9, wherein the electronic feedback circuit is powered by the power transfer circuit.

17. The power transfer system of claim 1, wherein power from the power transfer circuit is used for a lighting or sound application.

18. The power transfer system of claim 1, wherein the first and second coils comprise primary and secondary coils, and further comprising a resonant circuit located only on the primary coil and not on the secondary coil.

19. The power transfer system of claim 1, wherein the resonant circuit power driver comprises a self resonant driver producing sine waves which runs synchronous with the resonant frequency regardless of load.

20. The power transfer system of claim 1, wherein the frequency of the resonant circuit power driver remains synchronous with the resonant frequency as load on the power driver changes.

21. The power transfer system of claim 20, further comprising a zero crossing detection circuit providing trigger signals to the resonant circuit power driver.

22. The power transfer system of claim 1, wherein the at least one glass portion comprises at least a movable glass portion.

* * * * *